US008606542B2

(12) United States Patent
Öberg

(10) Patent No.: US 8,606,542 B2
(45) Date of Patent: Dec. 10, 2013

(54) METHOD AND SYSTEM FOR MONITORING AND DOCUMENTING INSTALLATION OF ROCK REINFORCEMENT BOLT

(75) Inventor: Fredrik Öberg, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 3 days.

(21) Appl. No.: 11/792,502

(22) PCT Filed: Nov. 28, 2005

(86) PCT No.: PCT/SE2005/001783

§ 371 (c)(1), (2), (4) Date: Jun. 6, 2007

(87) PCT Pub. No.: WO2006/079198

PCT Pub. Date: Jul. 27, 2006

(65) Prior Publication Data

US 2008/0085161 A1 Apr. 10, 2008

(30) Foreign Application Priority Data

Jan. 19, 2005 (SE) ..... 0500135

(51) Int. Cl.
*F16B 31/02* (2006.01)

(52) U.S. Cl.
USPC ..... 702/182; 702/42; 702/138; 73/761

(58) Field of Classification Search
USPC ..... 702/6, 33, 35–44; 405/259.1–259.6; 73/761
See application file for complete search history.

(56) References Cited

U.S. PATENT DOCUMENTS

| | | | | |
|---|---|---|---|---|
| 4,508,035 | A | 4/1985 | Mashimo et al. | |
| 4,581,712 | A * | 4/1986 | Perry et al. | 702/138 |
| 4,759,888 | A * | 7/1988 | Brest van Kempen | 405/259.5 |
| 7,320,560 | B2 * | 1/2008 | Persson et al. | 405/259.3 |

FOREIGN PATENT DOCUMENTS

| | | | |
|---|---|---|---|
| EP | 1445419 | | 8/2004 |
| FR | 2739134 | | 7/1997 |
| GB | 2 076168 | A | 11/1981 |
| WO | 03048524 | | 6/2003 |
| WO | 03069122 | | 8/2003 |
| WO | WO 03/069122 | A2 * | 8/2003 |
| WO | WO 03069122 | A2 * | 8/2003 |
| WO | WO 03/085233 | A1 | 10/2003 |
| WO | WO 2004099570 | A1 * | 11/2004 |

* cited by examiner

*Primary Examiner* — Manuel L Barbee
(74) *Attorney, Agent, or Firm* — Mark P. Stone

(57) ABSTRACT

A system for monitoring and documenting the installation of at least one rock reinforcement bolt in a tunnel or a mine, wherein bolt installation related information is stored and related to the identity of the bolt is distinguished by means (S1, S2, S3, 4) for registering of at least one bolt installation related parameter and means for storing the corresponding installation parameter data in a related memory (M), and means (S4, 4) for registering the installation position and means for storing the corresponding installation position data in a related memory (M). The invention also concerns a method.

13 Claims, 2 Drawing Sheets

METHOD AND SYSTEM FOR MONITORING AND DOCUMENTING INSTALLATION OF ROCK REINFORCEMENT BOLT

FIELD OF THE INVENTION

The invention concerns a method and a system for monitoring and documenting the installation of at least one rock reinforcement bolt according to the preamble of claims 1 and 9, respectively.

BACKGROUND OF THE INVENTION

Rock reinforcement in tunnels and mines is accomplished by installing a number of rock bolts distributed over the rock faces of the walls and roofs of tunnels and galleries. To the extent that the installation is documented, this is carried our manually by notes on paper, but most commonly the installation is not documented at all.

A manual documentation process is, however, time consuming and unreliable. It is often difficult to assure the quality of the reinforcement installation, in particular since, in particular in tunnels, the rock bolts are very often covered with so called shotcrete shortly after the installation.

AIM AND MOST IMPORTANT FEATURES OF THE INVENTION

It is an aim of this invention to improve a method and a system as above in such a way that the above problems are avoided or at least reduced. In particular it is an aim of the invention to provide a reliable method and system which allows economic and fast monitoring of reinforcement installations.

These aims are obtained with a method and a system according to claim 1 and 9, respectively.

Hereby installation parameter data and installation position data are stored automatically so as to be subsequently available for overviewing the complete reinforcement installation so as to ensure that the installation is complete and of sufficient quality.

It is preferred that it is evaluated whether the individual bolt has been installed according to the installation parameter and/or installation position requirements in order to verify the quality of the installation of the individual bolt.

In particular it is preferred that installation parameter data and/or installation position data are compared with previously stored target data (or reference or desired data), whereby target data can be set individually, if necessary or desired, for individual positions of the tunnel or mine to be reinforced.

In particular it is also preferred that the evaluation step results in a warning indication in the event that the comparison reveals that target data are not met. Hereby the operator can be alerted immediately and for example initiate the installation of a new bolt instead of a defective one. A warning indication should also be issued if an insufficient number of bolts are installed within a specific area.

It is preferred that stored data are transformed into a form that can be visualized, either in paper form or, most preferred, in digital image form. Hereby the data can be examined on a monitor inside or near the installation rig and/or at a remote position, for instance via the internet.

A visualisation can result in 3D-images that gives a clear indication for the contractor as well as for the owner of the project, so that the project as a whole can be easily reviewed with respect to what rock reinforcement that in fact has been installed.

Installation parameters are, in case of an expandable tubular bolt which is expanded with pressure fluid: maximum pressure reached during expansion, duration of expansion time above a predetermine pressure level, bolt tension, bolt type, bolt length, bolt diameter, and possible volume of anchoring grout.

For a common rock reinforcement bolt which may have for example mechanical such as screw tread expansion means or no expansion means at all, here named non-tubular bolt, the installation parameters are: expansion tension, bolt tension, bolt type, bolt length, bolt diameter, and possible volume of anchoring grout.

For other kinds of bolts, other parameters may be of interest to log.

It is preferred that during the installation process, the operator is supported by the system providing target information such as position of bolt, type of bolt to be installed, dimensions of bolt to be installed etc. It is not excluded that the entire installation is automatized or distance controlled.

Corresponding advantages are obtained with corresponding system feature claims.

BRIEF DESCRIPTION OF DRAWINGS

The invention will now be described in more detail at the background of an embodiment and with the aid of the annexed drawings, wherein.

DESCRIPTION OF EMBODIMENT

Figure 1:
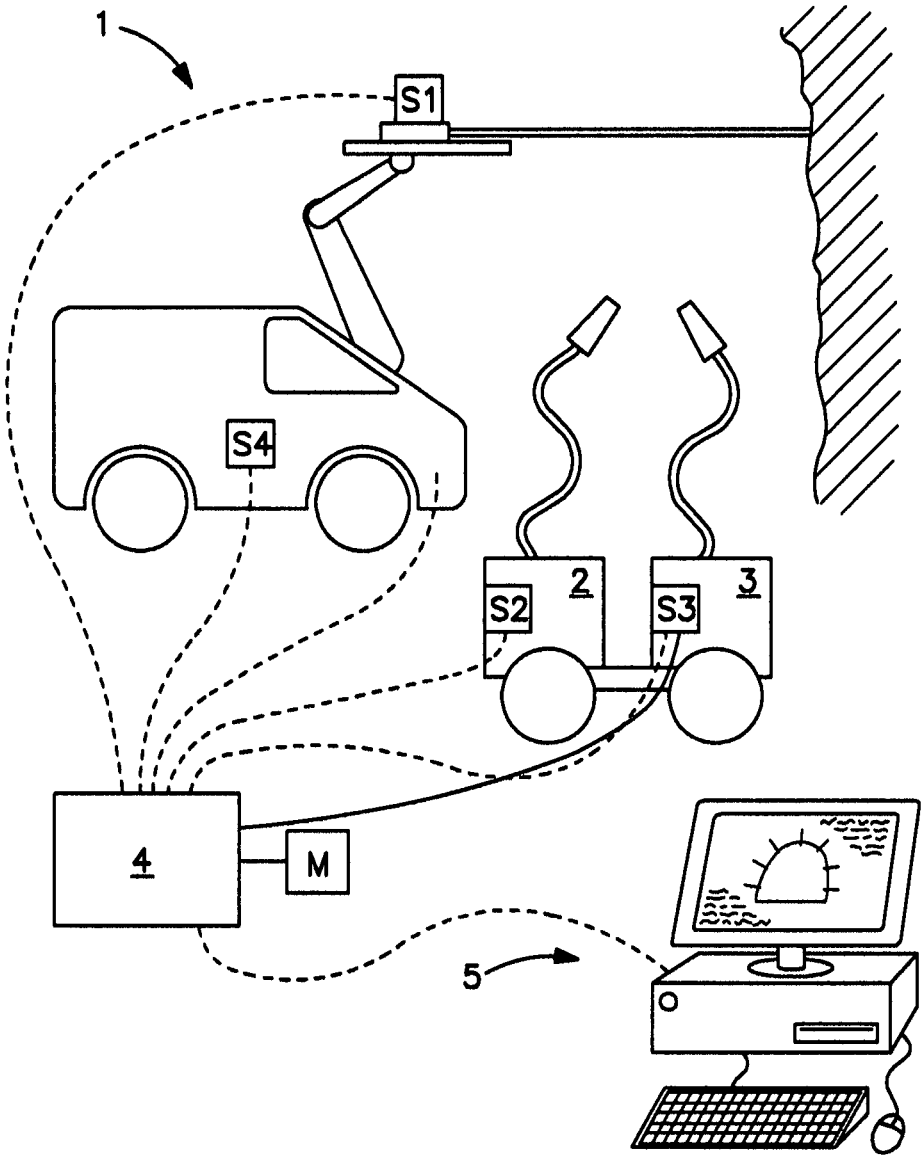
FIG. 1 shows diagrammatically a system according to the invention in connection with a reinforcement bolt installation rig.

In FIG. 1 numeral 1 in general denotes a rig for installation of rock face reinforcement.

For that purpose drill rig 1 includes a moveable carrier having an arm carrying a slide for a drilling machine. The rig 1 is connected to a central processing unit (CPU) 4 which on the one hand, controls the movement of the rig 1 and on the other hand monitors the position, direction and drilled distance etc with respect of the drilling machine. S1 indicates in general sensor means for sensing the operation of the drilling machine.

The CPU can be positioned on the carrier or at a distant location. There can also be arranged one separate computer for controlling the rig and one for controlling the action of the drilling machine. S4 indicates in general sensor means for sensing the position and operation of the carrier.

In case of the installation of self-drilling reinforcement bolts, the drilling machine is adapted in a manner known per see by one skilled in the art for the installation of such bolts.

Numeral 2 indicates a bolt expansion equipment including high pressure water producing and/or delivering means, a conduit for delivering high pressure water to a bolt inserted in a bore hole including a coupling nozzle and (not shown) sensor means S2 for sensing maximum pressure reached during expansion as well as duration of time when the pressure is above a predetermined pressure level. This in order to secure that the bolt has been properly expanded.

Numeral 3 denotes equipment for injecting anchoring grout into a bolt hole and includes per see known means for carrying out the grout injecting procedure. The equipment 3 also includes sensor means S3 for sensing volume of anchoring grout.

Rig 1, and the bolt expansion equipment 2 and the anchoring grout and injecting equipment 3 are all connected to the central processing unit 4, which hereby is capable of monitoring and documenting installation parameter data as well as installation position data, which data is stored in a memory M which is connected to or integrated in the CPU 4.

CPU 4 is intended to be connected to a computer 5, such as a PC, either over a cable or otherwise. The PC 5 may thus be located adjacent to the rig 1 or at a distance there from. It is also possible to multiply the PC 5, so that one PC is located adjacent to the rig and one or more PC is (are) at distance position (–s), for example at a control centre. Hereby it is possible to monitor and document installations carried out by not only one but also several rigs 1 in one tunnel or mine or in plural tunnels or mines.

By the installation of suitable software it is for example possible to present visually to a contractor or a project owner reinforcement made in a specific tunnel or mine in different formats, for example in 3D on a monitor.

Through the application of suitable software it is also possible to support installation at the site by providing positioning information from a memory M so as to be presented to an operator or, even so that the process can be controlled automatically or from a distance in respect of at least some of the operations carried out such as drilling bolt holes and positioning reinforcement bolts.

Figure 2:
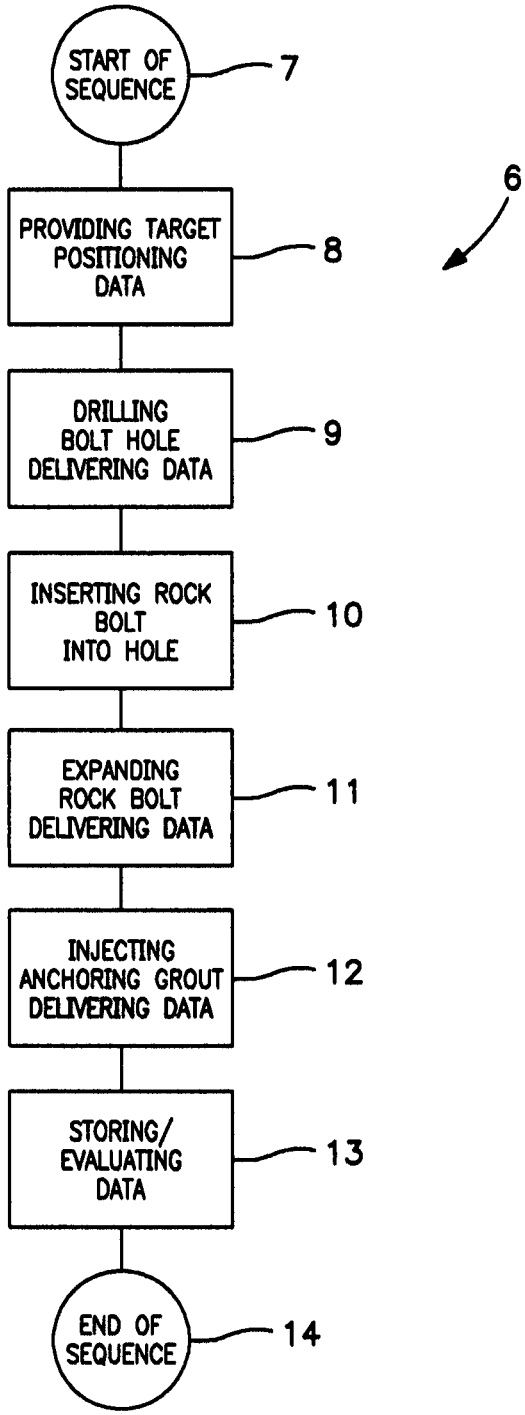
FIG. 2 shows a sequence diagram over a method according to the invention.

In FIG. 2 there is shown a sequence 6 over a method of monitoring and documenting according to the invention, wherein:

Position 7: indicates start of the sequence;

Position 8: indicates providing target positioning data from a memory to an operator of a drill rig;

Position 9: drilling a bolt hole and delivering bore hole data, such as bore hole length to CPU;

Position 10: inserting rock bolt of described dimensions in bore hole;

Position 11: expanding rock bolt; delivering expansion data (pressure, time) to CPU;

Position 12: injecting anchoring grout; delivering injection data signals to CPU;

Position 13: storing data in memory; evaluating data so as to emit an OK signal if data meet target data or a warning indication if data does not meet target data;

Position 14 is end of sequence.

The invention can be modified within the scope of the following claims. As an example, different types of rock bolts can be installed. In case of an expandable tension bolt, tension applied to the bolt by screwing or otherwise may be monitored, and a corresponding signal be transmitted to the CPU.

In case of expandable tubular bolts, the step concerning injecting anchoring grout may be left out. It is also possible that target positioning data are not provided to be operator. In that case, installation of the individual bolts may be made with the aid of installation instructions, maps etc.

The invention claimed is:

1. Method of monitoring and documenting the installation of at least one rock reinforcement bolt in a tunnel or a mine, wherein bolt installation related information is stored and related to the identity of the bolt, said method comprising the steps of:

supporting installation positioning by providing target positioning information from a memory, registering, by parameter registering means during rock bolting, at least one bolt installation related parameter for said at least one rock reinforcement bolt and storing the corresponding installation parameter data in a related memory, registering, by position registering means during rock bolting, the installation position for said at least one rock reinforcement bolt and storing the corresponding installation position data in a related memory, and evaluating, by evaluating means, whether the said at least one rock reinforcement bolt has been installed according to installation parameter and installation position requirements;

wherein the step of evaluating includes comparing stored installation parameter data and stored installation position data with previously stored target data, and wherein said installation parameter is one or more from the group: maximum pressure reached during expansion, duration of time when pressure is above a predetermined pressure level, bolt tension, expansion tension, volume of anchoring grout.

2. Method according to claim 1, wherein the step of evaluating includes generating a warning indication in the event that the comparison reveals that target data are not met.

3. Method according to claim 1, including the step of transforming stored data into a form that can be visualized.

4. Method according to claim 1, wherein said bolt is one from the group: a pressure fluid expandable tubular bolt, a non-tubular bolt with mechanical expansion means.

5. Method according to claim 1, wherein said method is performed in association with the control system of a rock bolting rig.

6. Method according to claim 1, wherein said method is distance controlled.

7. System for monitoring and documenting the installation of at least one rock reinforcement bolt in a tunnel or a mine, wherein bolt installation related information is stored and related to the identity of the bolt, the system including:

means for providing target positioning information from a memory in order to support installation positioning, means for registering of at least one bolt installation related parameter and means for storing the corresponding installation parameter data in a related memory, means for registering the installation position during rock bolting and means for storing the corresponding installation position data in a related memory, means for evaluating whether the bolt has been installed according to installation parameter and installation position requirements, at least one of said aforementioned means, in addition to said means for registering the installation position, operating during rock bolting, wherein the means for evaluating includes means for comparing stored installation parameter data and stored installation position data with previously stored target data, and wherein said installation parameter is one or more from the group: maximum pressure reached during expansion, duration of time when pressure is above a predetermined pressure level, bolt tension, expansion tension, volume of anchoring grout.

8. System according to claim 7, comprising means for delivering a warning indication in the event that the comparison reveals that target data are not met.

9. System according to claim 7, comprising means for transforming stored data into a form that can be visualized.

10. System according to claim 7, wherein said system is arranged for monitoring and documenting the installation of at least one bolt from the group: a pressure fluid expandable tubular bolt, a non-tubular bolt with mechanical expansion means.

11. System according to claim 7, wherein said system is integrated or associated with a control system of a rock bolting rig.

12. System according to claim 11, wherein the memory is connected to or integrated in the control system of a rock bolting rig.

13. System according to claim 7, wherein said system is arranged to be distance controlled.

* * * * *